US005630512A

United States Patent [19]

Wells

[11] Patent Number: 5,630,512

[45] Date of Patent: May 20, 1997

[54] DISPLAY AND STORAGE CONTAINER APPARATUS

[76] Inventor: E. Laura Wells, 262 Lakeshore Dr., Pleasant Valley, N.Y. 12569

[21] Appl. No.: 606,210

[22] Filed: Feb. 23, 1996

[51] Int. Cl.[6] ..... B65D 5/44

[52] U.S. Cl. ..... 206/776; 206/782; 40/312; 40/661

[58] Field of Search ..... 206/769, 770, 206/771, 772, 773, 774, 459.5, 457, 775, 776, 778, 782; 40/312, 313, 661

[56] References Cited

U.S. PATENT DOCUMENTS

| | | | |
|---|---|---|---|
| D. 254,114 | 2/1980 | Lyman et al. . | |
| D. 306,377 | 3/1990 | Cotutsca . | |
| 4,047,633 | 9/1977 | Trombly | 40/312 X |
| 4,199,883 | 4/1980 | Cross . | |
| 4,432,151 | 2/1984 | Morris | 40/661 |
| 4,779,368 | 10/1988 | Thede . | |
| 4,897,948 | 2/1990 | Owen | 40/661 |
| 4,901,456 | 2/1990 | Cotutsca . | |
| 4,991,336 | 2/1991 | Lucke . | |
| 5,077,921 | 1/1992 | Mooney . | |
| 5,199,568 | 4/1993 | Streit et al. | 206/771 X |
| 5,275,277 | 1/1994 | Gallegos | 206/457 X |

*Primary Examiner*—Jacob K. Ackun

[57] ABSTRACT

A display and storage container apparatus includes a base member and a set of inner wall members which project upward from the top surface of the base member. The base member and the inner wall members define an interior storage space. A set of transparent outer wall members also project upward from the top surface of the base member. Each of the transparent outer wall members is spaced from an adjacent inner wall member by a gap, such that each gap provides a graphic reception region for receiving a graphic element for display. A graphic element is visible from the outside of the display and storage container apparatus through a transparent outer wall member. A cover assembly is supported by the transparent outer wall members for covering the graphic reception region and the interior storage space. A rotation assembly can be attached to the bottom surface of the base member. The rotation assembly permits the base member to rotate on the rotation assembly when the rotation assembly is supported by an underlying support. A set of brace assemblies is supported by the base member and extends upward from the base member for supporting an inner wall member. A set of display and storage container apparatuses includes a first, a second, a third, and a fourth display and storage container apparatus which are nested together for storage.

6 Claims, 3 Drawing Sheets

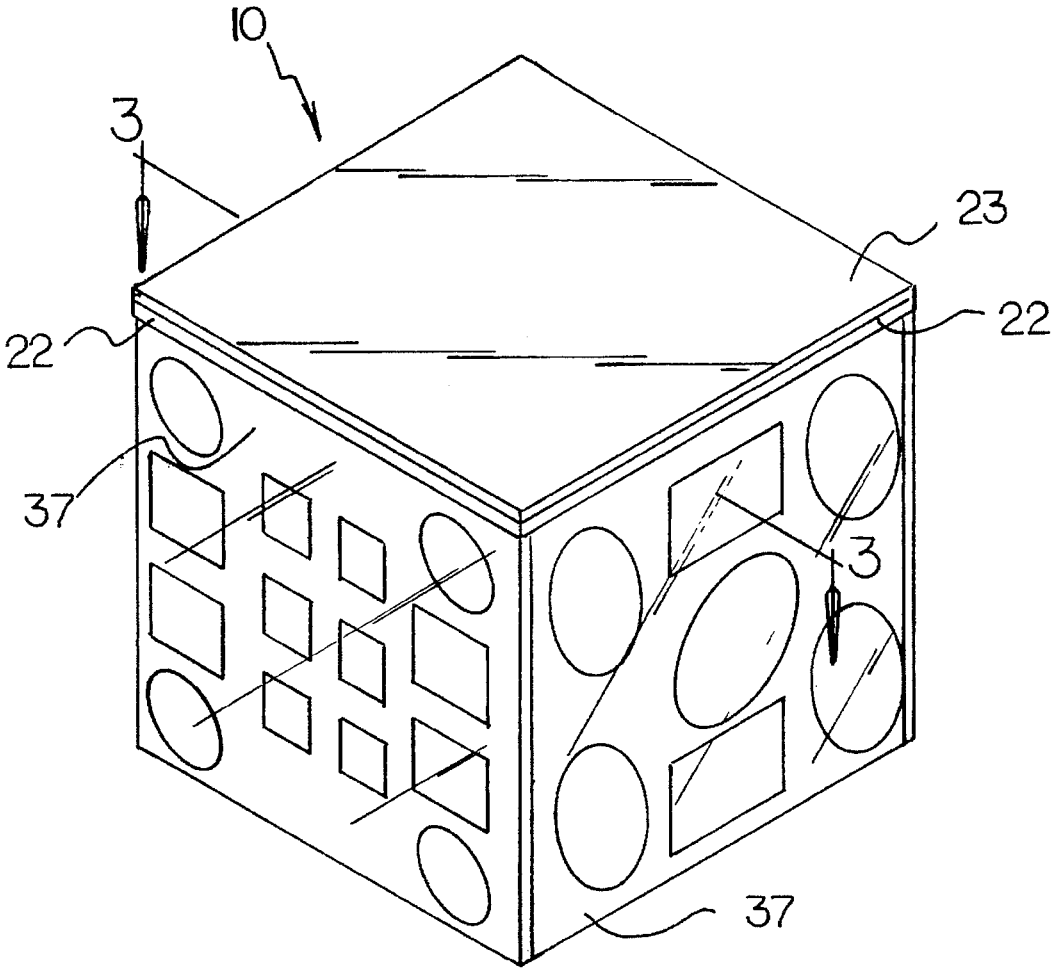
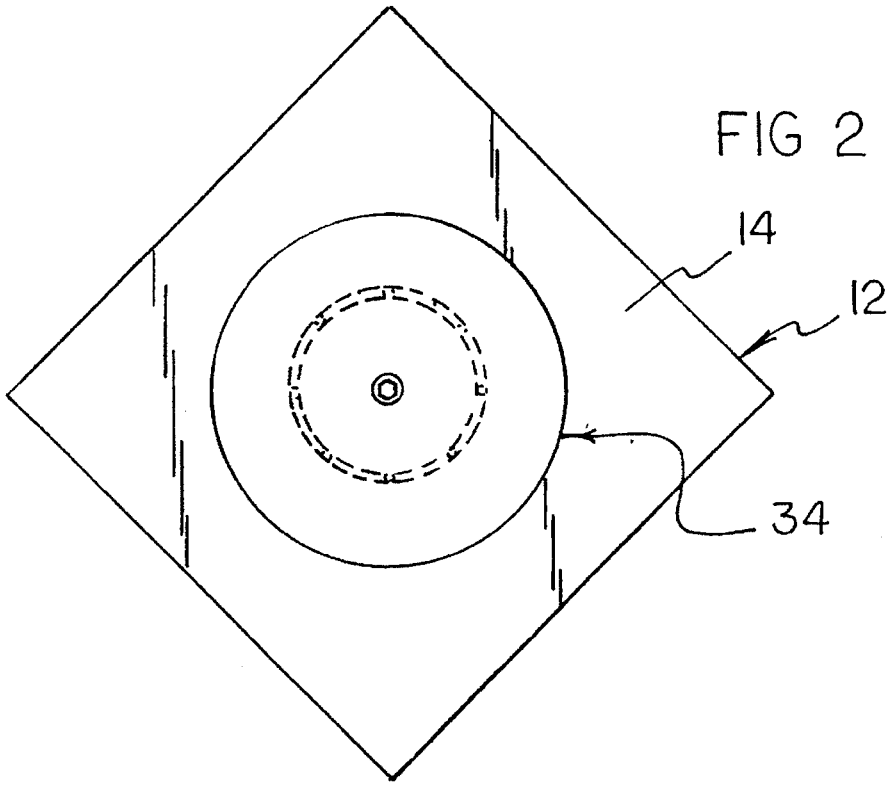
FIG 2

DISPLAY AND STORAGE CONTAINER APPARATUS

BACKGROUND OF THE INVENTION

1. Field of the Invention

The present invention relates generally to storage containers and, more particularly, to storage containers especially adapted for displaying graphic matter that is visible from outside of the storage container.

2. Description of the Prior Art

Storage containers are well known for storing articles having many shapes and sizes. Most often the articles stored inside a storage container are not visible from outside the storage container. As a result, there is often a mystery as to what is stored in a specific storage container. Often purely utilitarian storage containers are provided with hand-written-upon adhesive labels to identify the contents of the storage containers. Such purely utilitarian storage containers may not be suitable for persons who want a storage container that also has decorative purposes. In this respect, it would be desirable ff a storage container were provided with indicia of the contents of the container which do not include hand-written-upon adhesive labels.

More specifically, many persons like to keep photograph albums readily available in rooms they entertain guests so that the guests can readily view the photograph albums. Because there may be quite a few photograph albums to view, and because it may be desirable to keep the photograph albums free from dust and dirt when they are not being viewed, it may be desirable to keep the photograph albums in a storage container when they are not in use. Because it would be desirable to keep such a storage container in the room where the guests are entertained, it would be desirable if such a photograph album storage container were provided with a decorative display of one or more photographs to indicate that the contents of the storage container are photograph albums.

It is noted that throughout the years, a number of innovations have been developed relating to displaying one or more photographs simultaneously, and the following U.S. patents are representative of some of those innovations: U.S Pat. Nos. 4,199,883, 4,779,368, 4,901,456, 4,991,336, 5,077,921, U.S. Pat. Des. No. 254,114, and U.S. Pat. Des. No. 306,377. Although the above-listed patents vary in many ways, they share a common characteristic. None of the above-cited patents discloses a photograph display that also includes a storage container for storing photograph albums.

Still other features would be desirable in a photograph display and album storage container apparatus. For example, to facilitate a person's viewing of all sides of a display and storage container apparatus, it would be desirable if the display and storage container apparatus were readily rotatable on a base.

Photograph albums come in a wide variety of shapes and sizes. Consequently, relatively small photograph albums can be stored in relatively small display and storage containers. Intermediate size photograph albums can be stored in intermediate size display and storage containers. Relatively large photograph albums can be stored in relatively large display and storage containers. In this respect, it would be desirable if a set of display and storage containers were provided to accommodate a variety of sizes of photograph albums.

When a set of different size display and storage containers are provided for storing different size photograph albums, there may be times when the display and storage containers are not in use. Consequently, for purposes of storage of the set of containers themselves, it would be desirable if the set of display and storage containers were nestable within one another for storing the containers themselves.

After particular photographs are selected for storage and display, it may be desirable to remove the selected photographs to replace them with different photographs. In this respect, it would be desirable if a photograph display and album storage container were provided which permits displayed photographs to be readily removed and replaced.

Thus, while the foregoing body of prior art indicates it to be well known to use displays for photographs, the prior art described above does not teach or suggest a display and storage container apparatus which has the following combination of desirable features: (1) is provided with indicia of the contents of the container which do not include hand-written-upon adhesive labels; (2) provides a photograph album storage container having a decorative display of one or more photographs to indicate that the contents of the storage container are photograph albums; (3) is readily rotatable on a base; (4) provides a set of display and storage containers to accommodate a variety of sizes of photograph albums; (5) provides storage containers which are nestable within one another for storing the containers themselves; and (6) permits displayed photographs to be readily removed and replaced. The foregoing desired characteristics are provided by the unique display and storage container apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a display and storage container apparatus which includes a base member which includes a top surface and a bottom surface. A set of inner wall members project upward from the top surface of the base member. The base member and the inner wall members define an interior storage space. A set of transparent outer wall members also project upward from the top surface of the base member. Each of the transparent outer wall members is spaced from an adjacent inner wall member by a gap, such that each gap provides a graphic reception region for receiving a graphic element for display. A graphic element is visible from the outside of the display and storage container apparatus through a transparent outer wall member. A cover assembly is supported by the transparent outer wall members for covering the graphic reception region and the interior storage space.

A rotation assembly can be attached to the bottom surface of the base member. The rotation assembly permits the base member to rotate on the rotation assembly when the rotation assembly is supported by an underlying support. The cover assembly includes a set of cap members. Each cap member is placed on a top edge of a respective transparent outer wall member and on a top edge of an adjacent inner wall member for covering the graphic reception region between the respective transparent outer wall member and the adjacent inner wall member. A planar cover member is placed on top of the cap members for covering the interior storage space.

A set of brace assemblies is supported by the base member and extends upward from the base member for supporting an inner wall member. The set of brace assemblies includes a set of strut members, wherein each strut member extends upward from the base member adjacent to two adjacent inner wall members. A set of transverse connectors is connected to each strut member, wherein each transverse connector extends transversely from a respective strut member for interconnecting between two adjacent inner wall members. The set of brace assemblies also includes a set of L-shaped connectors, wherein each L-shaped connector is connected between the base member and an inner wall member. Each brace assembly is located within the interior storage space.

A set of display and storage container apparatuses includes a first display and storage container apparatus, such as described above, and a second display and storage container apparatus, such as described above. The first display and storage container apparatus includes: a first base member which has first base member dimensions; a first set of inner wall members which has first inner wall dimensions; a first set of transparent outer wall members which has first outer wall dimensions; and a first cover assembly which has first cover assembly dimensions. The second display and storage container apparatus includes: a second base member which has second base member dimensions; a second set of inner wall members which has second inner wall dimensions; a second set of transparent outer wall members which has second outer wall dimensions; and a second cover assembly which has second cover assembly dimensions. The respective second dimensions are sufficiently smaller than the respective first dimensions, such that the second display and storage container apparatus can be stored in the interior storage space of the first display and storage container apparatus.

A third display and storage container apparatus, such as described above, which includes: a third base member which has third base member dimensions; a third set of inner wall members which has third inner wall dimensions; a third set of transparent outer wall members which has third outer wall dimensions; and a third cover assembly which has third cover assembly dimensions. The respective third dimensions are sufficiently smaller than the respective second dimensions, such that the third display and storage container apparatus can be stored in the interior storage space of the second display and storage container apparatus.

A fourth display and storage container apparatus, such as describe above, includes: a fourth base member which has fourth base member dimensions; a fourth set of inner wall members which has fourth inner wall dimensions; a fourth set of transparent outer wall members which has fourth outer wall dimensions; and a fourth cover assembly which has fourth cover assembly dimensions. The respective fourth dimensions are sufficiently smaller than the respective third dimensions, such that the fourth display and storage container apparatus can be stored in the interior storage space of the third display and storage container apparatus.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved display and storage container apparatus which has all of the advantages of the prior art and none of the disadvantages.

It is another object of the present invention to provide a new and improved display and storage container apparatus which may be easily and efficiently manufactured and marketed.

It is a further object of the present invention to provide a new and improved display and storage container apparatus which is of durable and reliable construction.

An even further object of the present invention is to provide a new and improved display and storage container apparatus which is susceptible of a low cost of manufacture with regard to both materials and labor, and which accordingly is then susceptible of low prices of sale to the consuming public, thereby making such display and storage container apparatus available to the buying public.

Still yet a further object of the present invention is to provide a new and improved display and storage container apparatus which is provided with indicia of the contents of the container which do not include hand-written-upon adhesive labels.

Still another object of the present invention is to provide a new and improved display and storage container apparatus that provides a photograph album storage container having a decorative display of one or more photographs to indicate that the contents of the storage container are photograph albums.

Yet another object of the present invention is to provide a new and improved display and storage container apparatus which is readily rotatable on a base.

Even another object of the present invention is to provide a new and improved display and storage container apparatus that provides a set of display and storage containers to accommodate a variety of sizes of photograph albums.

Still a further object of the present invention is to provide a new and improved display and storage container apparatus which provides storage containers which are nestable within one another for storing the containers themselves.

Yet another object of the present invention is to provide a new and improved display and storage container apparatus that permits displayed photographs to be readily removed and replaced.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the display and storage container apparatus of the invention.

FIG. 2 is a bottom view of the embodiment of the display and storage container apparatus shown in FIG. 1.

DESCRIPTION OF THE PREFERRED EMBODIMENT

Figure 3:
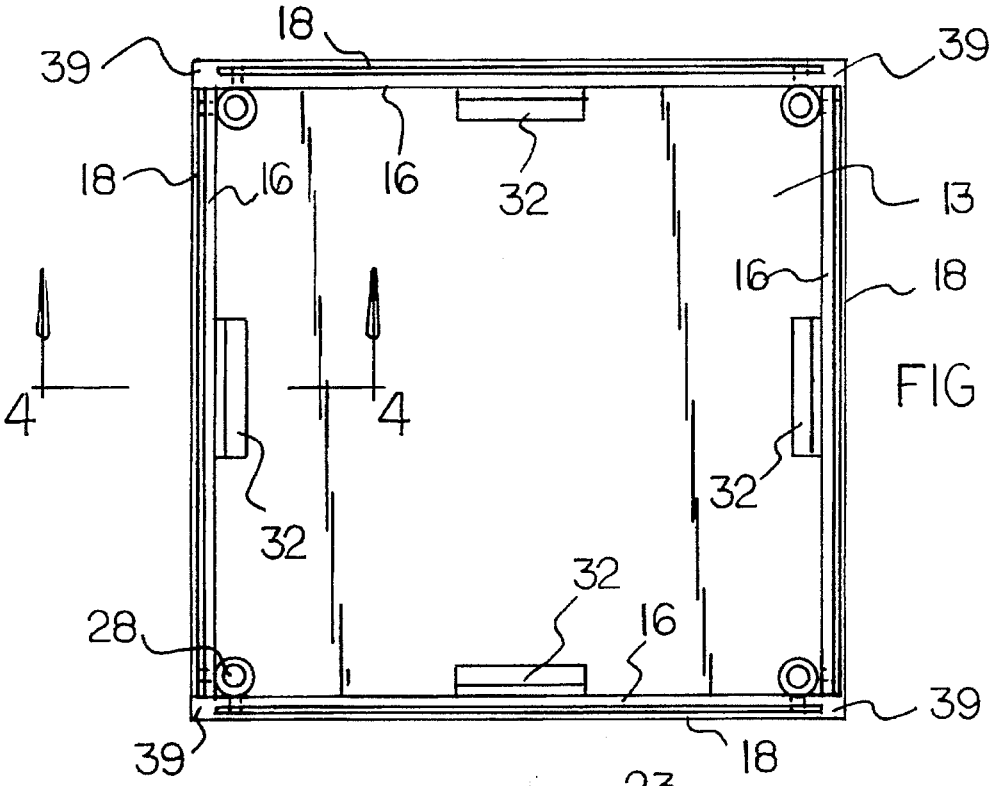
FIG. 3 is a cross-sectional view of the embodiment of the display and storage container apparatus of FIG. 1 taken along line 3—3 thereof.
Figure 4:
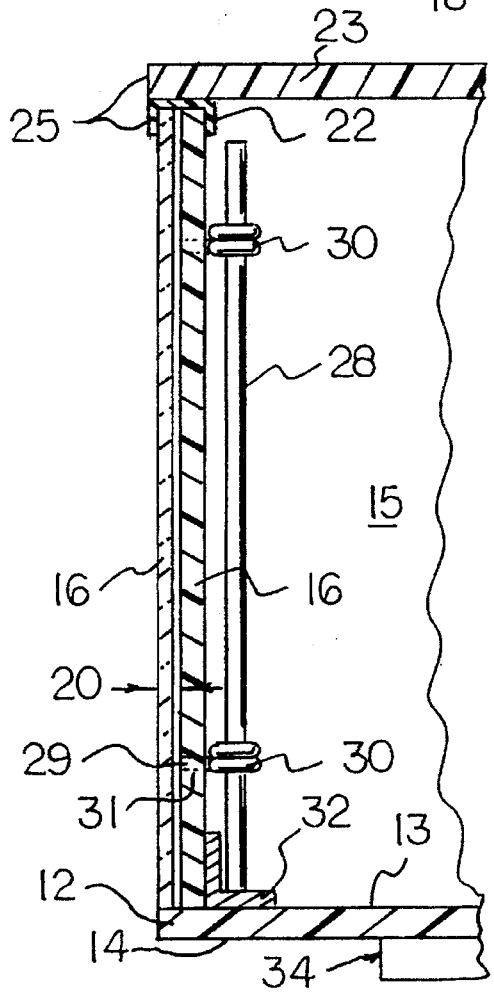
FIG. 4 is a partial perspective view of the embodiment of the invention shown in FIG. 3 taken along line 4—4 thereof.

With reference to the drawings, a new and improved display and storage container apparatus embodying the principles and concepts of the present invention will be described.

Turning to FIGS. 1–4, there is shown an exemplary embodiment of the display and storage container apparatus of the invention generally designated by reference numeral 10. In its preferred form, display and storage container apparatus 10 includes a base member 12 which includes a top surface 13 and a bottom surface 14. A set of inner wall members 16 project upward from the top surface 13 of the base member 12. The base member 12 and the inner wall members 16 define an interior storage space 15. A set of transparent outer wall members 18 also project upward from the top surface 13 of the base member 12. Each of the transparent outer wall members 18 is spaced from an adjacent inner wall member 16 by a gap 20, such that each gap 20 provides a graphic reception region for receiving a graphic element for display. A graphic element is visible from the outside of the display and storage container apparatus 10 through a transparent outer wall member 18. A cover assembly 25 is supported by the transparent outer wall members 18 for covering the graphic reception region and the interior storage space 15. A frame member 39 is provided between peripheral edges of each transparent outer wall member 18 and each inner wall member 16 for providing bracing between the transparent outer wall members 18 and the inner wall members 16.

Individual photographs, arrays of plural photographs, or other graphic media can be stored and displayed in the graphic reception regions between the transparent outer wall members 18 and the inner wall members 16. In FIG. 1, each graphic reception region includes an array of photographs carried by a different display card 37. It is noted that for purposes of simplicity, the display cards 37 are not shown in FIGS. 3 and 4. The interior storage space 15 can be used for storing photograph albums, individual photographs, or any other articles that can fit into the interior storage space 15.

The display and storage container apparatuses 10 can be made in any desired size. Very large units can be used as tables. Smaller units can be used as table top versions. Break down cardboard boxes can be packaged with the units for storage.

A rotation assembly 34 can be attached to the bottom surface 14 of the base member 12. The rotation assembly 34 permits the base member 12 to rotate on the rotation assembly 34 when the rotation assembly 34 is supported by an underlying support. An underlying support is not shown but is understood to be any one of a table, a desk, a coffee table, a floor, etc. The cover assembly 25 includes a set of cap members 22. Each cap member 22 is placed on a top edge of a respective transparent outer wall member 18 and on a top edge of an adjacent inner wall member 16 for covering the graphic reception region between the respective transparent outer wall member 18 and the adjacent inner wall member 16. A planar cover member 23 is placed on top of the cap members 22 for covering the interior storage space 15.

A set of brace assemblies is supported by the base member 12 and extends upward from the base member 12 for supporting an inner wall member 16. The set of brace assemblies includes a set of strut members 28, wherein each strut member 28 extends upward from the base member 12 adjacent to two adjacent inner wall members 16. A set of transverse connectors 30 is connected to each strut member 28, wherein each transverse connector 30 extends transversely from a respective strut member 28 for interconnecting between two adjacent inner wall members 16. Each of the transverse connectors 30 includes projecting end portions 29, and each of the inner wall members 16 includes receiving wells 31 for receiving the projecting end portions. The set of brace assemblies also includes a set of L-shaped connectors 32, wherein each L-shaped connector 32 is connected between the base member 12 and an inner wall member 16. Each brace assembly is located within the interior storage space 15.

Figure 5:
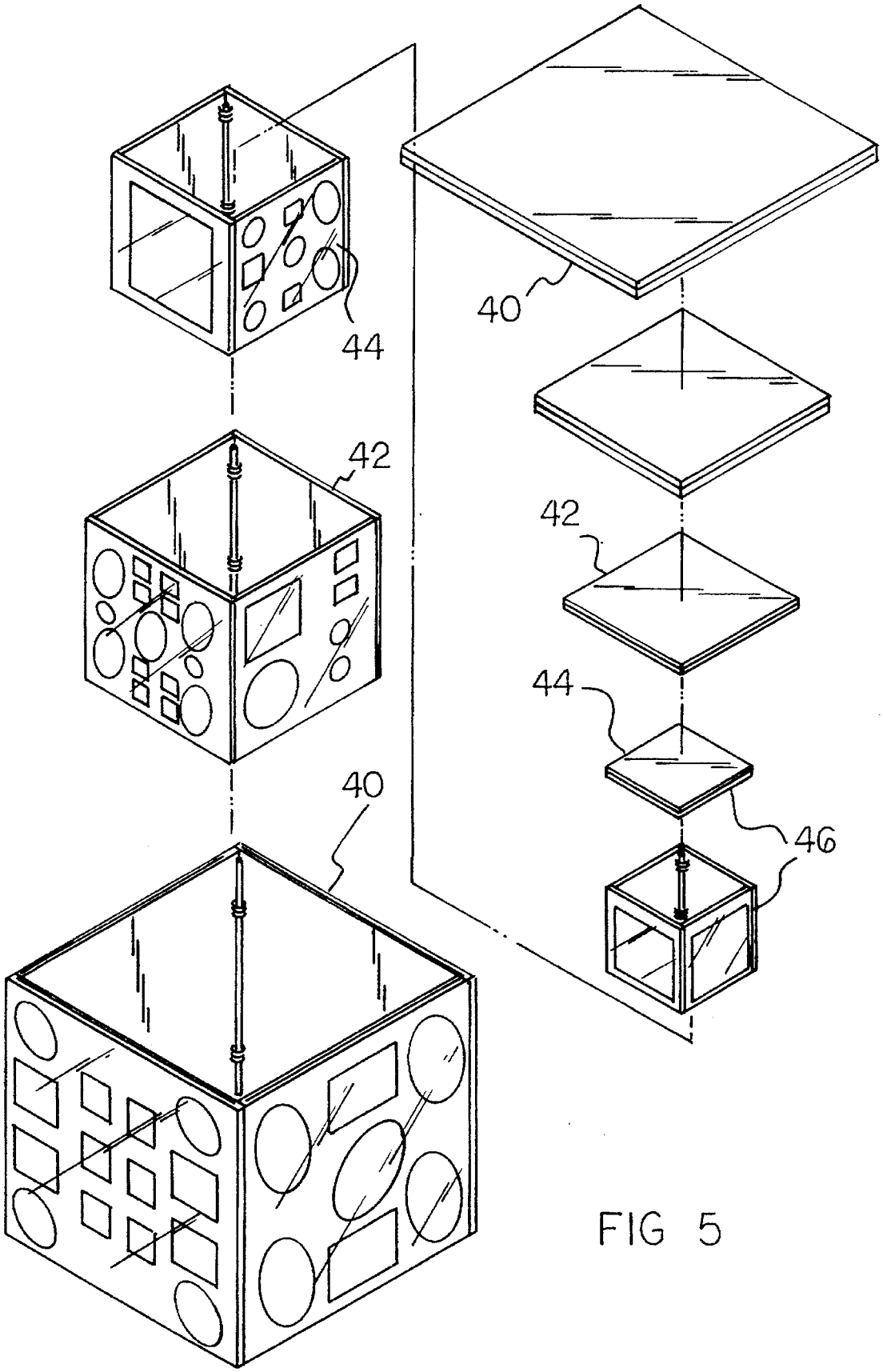
FIG. 5 is an exploded perspective view of a plurality of nested display and storage container apparatuses of the invention.

As shown in FIG. 5, a set of display and storage container apparatuses includes a first display and storage container apparatus 40, such as describe above, and a second display and storage container apparatus 42, such as described above. The first display and storage container apparatus 40 includes: a first base member which has first base member dimensions; a first set of inner wall members which has first inner wall dimensions; a first set of transparent outer wall members which has first outer wall dimensions; and a first cover assembly which has first cover assembly dimensions. The second display and storage container apparatus 42 includes: a second base member which has second base member dimensions; a second set of inner wall members which has second inner wall dimensions; a second set of transparent outer wall members which has second outer wall dimensions; and a second cover assembly which has second cover assembly dimensions. The respective second dimensions are sufficiently smaller than the respective first dimensions, such that the second display and storage container apparatus 42 can be stored in the interior storage space of the first display and storage container apparatus 40.

A third display and storage container apparatus 44, such as described above, which includes: a third base member which has third base member dimensions; a third set of inner wall members which has third inner wall dimensions; a third set of transparent outer wall members which has third outer wall dimensions; and a third cover assembly which has third cover assembly dimensions. The respective third dimensions are sufficiently smaller than the respective second dimensions, such that the third display and storage container apparatus 44 can be stored in the interior storage space of the second display and storage container apparatus 42.

A fourth display and storage container apparatus, such as describe above, includes: a fourth base member which has fourth base member dimensions; a fourth set of inner wall members which has fourth inner wall dimensions; a fourth set of transparent outer wall members which has fourth outer wall dimensions; and a fourth cover assembly which has fourth cover assembly dimensions. The respective fourth dimensions are sufficiently smaller than the respective third dimensions, such that the fourth display and storage container apparatus 46 can be stored in the interior storage space of the third display and storage container apparatus 44.

Clearly, because of the respective dimensions of the respective first, second, third, and fourth display and storage container apparatuses, they can be stored together in a nested relationship. It will be apparent that the storage container of smallest size may be advantageously used to store interiorly thereof a loose assortment of photographs, graphical elements, or other articles when disposed in the aforementioned nested relationship. Similarly, the interior of the largest storage container apparatus may be used to store such loose articles when not incorporating smaller units nested therein, or in the space between the next smallest nested unit and the largest storage container apparatus.

The components of the display and storage container apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved display and storage container apparatus that is low in cost, relatively simple in design and operation, and which may advantageously be used to provide indicia of the contents of the container which do not include hand-written-upon adhesive labels. With the invention, a display and storage container apparatus provides a photograph album storage container having a decorative display of one or more photographs to indicate that the contents of the storage container are photograph albums. With the invention, a display and storage container apparatus is provided which is readily rotatable on a base. With the invention, a display and storage container apparatus provides a set of display and storage containers to accommodate a variety of sizes of photograph albums. With the invention, a display and storage container apparatus provides storage containers which are nestable within one another for storing the containers themselves. With the invention, a display and storage container apparatus is provided which permits displayed photographs to be readily removed and replaced.

Thus, while the present invention has been shown in the drawings and fully described above with particularity and detail in connect/on with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use. For example, the planar cover member 23 also may be fabricated of transparent material and include support means in connection with the undersurface thereof for storing a photograph, illustration, or other graphic element or array of graphic elements which would be visible to an external observer. Similarly, the display and storage container apparatus 10 may have more or less than four inner/outer wall members, i.e., the transverse cross-sectional shape thereof may be triangular, square, rectangular, pentagonal, hexagonal, or other polygonal shape.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A display and storage container apparatus, comprising:

a base member which includes a top surface and a bottom surface, a set of inner wall members projecting upward from said top surface of said base member, wherein said base member and said inner wall members define an interior storage space, a set of transparent outer wall members projecting upward from said top surface of said base member, wherein each of said transparent outer wall members is spaced from an adjacent inner wall member by a gap, such that each gap provides a graphic reception region for receiving a graphic element for display, and a cover assembly, supported by said transparent outer wall members, for covering said graphic reception region and said interior storage space;

a set of brace assemblies supported by said base member and extending upward from said base member for supporting an inner wall member, wherein said set of brace assemblies includes a set of strut members, wherein each strut member extends upward from said base member adjacent to two adjacent inner wall members, and a set of transverse connectors connected to each strut member, wherein each transverse connector extends transversely from a respective strut member for interconnecting between two adjacent inner wall members, each of said transverse connectors including an eye through which the respective strut member extends, whereby removal of the strut member allows for separation of the adjacent inner wall members.

2. The apparatus of claim 1, further including:

frame members connected between peripheral edges of each transparent outer wall member and each adjacent inner wall member for providing bracing between said transparent outer wall members and said inner wall members.

3. The apparatus of claim 1, further including:

a rotation assembly attached to said bottom surface of said base member, wherein said rotation assembly permits said base member to rotate on said rotation assembly when said rotation assembly is supported by an underlying support.

4. The apparatus of claim 1 wherein said cover assembly includes:

a set of cap members, wherein each cap member is for placed on a top edge of a respective transparent outer wall member and on a top edge of an adjacent inner wall member for covering said graphic reception region between the respective transparent outer wall member and the adjacent inner wall member, and a planar cover member placed on top of said cap members for covering said interior storage space.

5. The apparatus of claim 1 wherein said set of brace assemblies includes:

a set of L-shaped connectors, wherein each L-shaped connector is connected between said base member and an inner wall member.

6. The apparatus of claim 1 wherein each brace assembly is located within said interior storage space.

* * * * *